United States Patent [19]

Flynn

[11] 4,190,471

[45] Feb. 26, 1980

[54] PYROTECHNIC DISSEMINATING FORMULATIONS

[75] Inventor: James P. Flynn, Midland, Mich.

[73] Assignee: The Dow Chemical Company, Midland, Mich.

[21] Appl. No.: 853,609

[22] Filed: Aug. 21, 1969

[51] Int. Cl.[2] ..... C06B 45/10

[52] U.S. Cl. ..... 149/19.6; 149/19.1; 149/83

[58] Field of Search ..... 149/19, 60, 61, 76, 149/83, 19.1, 19.6

[56] References Cited

U.S. PATENT DOCUMENTS

| | | | |
|---|---|---|---|
| 3,278,352 | 10/1966 | Erickson | 149/19 |
| 3,467,558 | 9/1969 | Wernette et al. | 149/19 |

*Primary Examiner*—Edward A. Miller

[57] ABSTRACT

Disclosed herein are novel psychotomimetic disseminating compositions comprising from about 40 to about 60 weight percent of the agent to be disseminated, from about 15 to about 40 percent of an inorganic chlorate or perchlorate oxidizer, and from about 15 to about 40 percent of a polymeric binder comprising an aliphatic sulfur-containing organic compound cured with an aliphatic sulfur-containing epoxy resin, or with a tris[2(1-aziridinyl) ethyl]benzene tricarboxylate.

6 Claims, No Drawings

PYROTECHNIC DISSEMINATING FORMULATIONS

BACKGROUND OF THE INVENTION

The invention described in this application for patent was made in the course of, or under a contract with the Department of the Army.

Heretofore problems have been encountered in disseminating certain agents such as those coded BZ, EA 3834, and EA 3580 by means of pyrotechnic munitions. Presently available munitions suffer from numerous deficiencies such as failure to give good yields of the aerosolized agent, lack of sufficient physical strength to withstand abuse, and compatibility problems between BZ and the binder, especially where the composition is stored for long periods of time at moderately elevated temperatures such as about 70° C. The present invention is generally superior to the prior art compositions in that it provides good yields of the aerosolized agent, and exhibits good physical strength and reagent compatibility.

THE INVENTION

The composition of the invention comprises by weight from about 40 to about 60 percent of a psychotomimetic agent, from about 15 to about 40 percent of an inorganic nitrate chlorate or perchlorate oxidizer, and from about 15 to about 40 percent of a polymeric binder. The binder comprises an aliphatic sulphur-containing organic compound having a plurality of mercapto groups (—SH) in the molecule and, as curing agent, a trifunctional tris[2(1-aziridinyl)ethyl]benzene tricarboxylate, or an aliphatic sulfur-containing epoxy resin having a functionality of at least about 1.5. The binder components should be combined in sufficient quantities so that the ratio of mercapto group equivalents to the reactive group equivalents of the curing agent is from about 0.6 to about 1.4. Preferably this ratio is from about 0.9 to about 1.1. Binder strength is at a maximum when the ratio is about 1.

In describing the invention, the equivalent weight (W) for a compound is equal to the molecular weight (M.W.) of the compound divided by the average number (F) of moles of epoxide, aziridine, or mercapto groups present in one mole of the compound. This last number F, is commonly known as the "functionality" of the compound. The number of equivalents (E) provided by a given compound is determined by the following formula:

$$E = \text{number of moles employed} \times (M.W./W)$$

In the binder, the aliphatic sulfur-containing compound is generally a liquid containing from about 18 to about 70 weight percent of chemically combined sulfur and preferably containing from about 25 to about 50 weight percent of sulfur. The compound also should have a mercapto group equivalent weight of from about 100 to 1300, and preferably from about 200 to about 800. Suitable examples of the aliphatic sulfur-containing portion of the binder are trifunctional thiols corresponding generally to the formula:

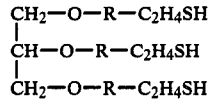

wherein R is an alkyl group having from 1 to 6 carbon atoms, or a sulfur containing alkyl or alkoxyl group having a similar number of carbon atoms. Other suitable aliphatic sulfur containing binder components are the polymeric condensation products of episulfides, and the polymeric condensation products the organo dihalides with inorganic polysulfides, e.g. $NaS_2$ and $NaS_4$. The polymeric sulfide resins generally have a molecular weight of from about 200 to about 2500. With the polymeric sulfide resins it is preferred that the mercapto groups be located at terminal or "end" positions on the polymer chain. Suitable polymeric sulfide resins are for example, the "Thiokol" brand polysulfide resins.

The aliphatic, sulfur-containing epoxy resin curing agents employed are liquids and have an epoxide equivalent weight of from about 100 to about 500, and a functionality of from about 1.5 to about 2.5. A suitable epoxy resin consists for example, of an alkyl sulfur-containing polymeric backbone with a plurality of glycidyl groups disposed thereon.

The trifunctional aziridinyl curing agents are tris[2(1-aziridinyl)ethyl]benzenetricarboxylates of the general formula:

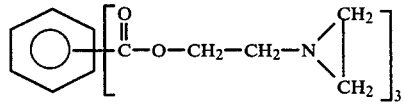

The substituent groups on the benzene nucleus can be in the 1,2,4 positions as in the trimellitate derivative or in the 1,2,3 positions as in the trimesate derivative.

The chlorate and perchlorate oxidizers are the alkali metal and ammonium chlorates and perchlorates. Preferably the oxidizer will be potassium chlorate or perchlorate.

Suitable psychotomimetic agents are the benzylic acid-derived agents. A primary example of such agents is "BZ". EA 3834 and EA 3580 can also be employed if in compounding the munition they are first sorbed onto an inert particulate carrier before the curing step. Optionally, these reagents can be employed as hydrochloride salts in which case sorption stabilization is not necessary.

PREFERRED EMBODIMENTS OF THE INVENTION

A preferred embodiment of the present invention to the composition wherein the binder comprises a trifunctional thiol cured with a liquid aliphatic sulfur-containing epoxy resin having an epoxide equivalent weight of from about 100 to about 500, with an epoxide functionality of from about 1.5 to about 2.5. Preferably in this embodiment of the invention a small amount of a polymeric sulfide resin will be employed to increase the "pot life" of the binder. Suitable sulfide resins are the episulfide condensation products and the condensation products of organo dihalides with inorganic polysulfides. The amount of polymeric sulfide employed should be from about 1 to about 8 percent based on the total weight of the munition, i.e. total weight of the binder, oxidizer and agent combined.

Another preferred embodiment of the present invention is the composition wherein the binder comprises a polymerized sulfide cured with a trifunctional aziridinyl benzenetricarboxylate. In the binder, the ratio of mercapto group equivalents to reactive (aziridinyl) group equivalents is from about 0.9 to about 1.1.

To formulate the munitions described above, the psychotomimetic agent is first admixed with the oxidizer to achieve a homogeneous blend. The blended ingredients are then admixed with the liquid binder components until the solids of the oxidizer and agent mixture are "wetted". The resulting composition is then "tamped" or otherwise packed under pressure into a suitable casing.

The munitions of the invention can be cured in several different temperature ranges. Where the curing agent is an aziridine, "curing" can be accomplished in from 4 to 20 hours at temperatures of from 60° to 100° C. Where the curing agent is an epoxide and a polymeric sulfide is employed, as a coreactant, curing can be accomplished in about two hours at temperatures of 60° C. to 70° C. Without the polymeric sulfide, epoxide compositions cure at 25° C. in about 2 hours.

The following examples are set forth to illustrate the invention.

EXAMPLE 1

About 2.5 grams of particulate potassium chlorate were admixed with about 4.5 grams of particulate BZ to form a dry blend. The dry blend was admixed with about 1.3 grams of a difunctional epoxy resin corresponding generally to the formula:

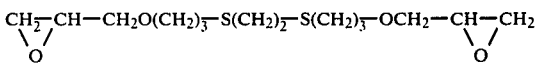

Subsequently a blend consisting of about 1.3 grams of a trifunctional thiol and about 0.5 gram of a polymeric sulfide was added to the epoxy-solids mixture, and the resulting composition was mixed until the solids (BZ and $KClO_3$) were thoroughly wetted. The trifunctional thiol employed corresponded in general to the formula:

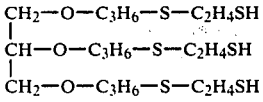

The polymeric sulfide corresponded generally to the formula:

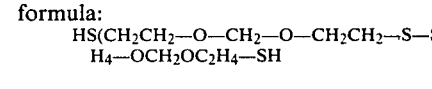

For this resin the mercapto group equivalent weight was about 250.

After the solids were thoroughly "wetted", the mixture was tamped into a 10 gram cylindrical steel cannister to form an end-burning grain. The munition was cured at a temperature of about 60° C. for a period of about 2 hours.

Upon ignition, the burning rate was about 2 inches per minute. The yield (% of agent aerosolized) was determined by the following formula:

$$\text{yield} = \frac{\text{weight of agent aerosolized}}{\text{total weight of the formulation}} \times 100$$

The yield was about 25 percent.

Other tests using similar munitions showed that the yield and physical characteristics of the munition were not impaired by storage for 12 weeks at about 70° C.

EXAMPLE 2

About 5 grams of BZ was admixed with about 2.5 grams of potassium chlorate. The viscous binder was admixed with the dry blend of BZ and oxidizer. The binder consisted of about 0.3 grams of tris[2(1-aziridinyl)ethyl]trimellitate and about 2.2 grams of LP 33, a "Thiokol" brand polymeric sulfide resin with a mercapto group equivalent weight of about 500. In the binder the ratio of mercapto group equivalents to reactive group equivalents (of the aziridine resin) was about 1.

The uncured munition was tamped into a 10 gram cylindrical steel cannister and was cured at 70° C. for 20 hours. Upon ignition, the yield of agent aerosolized was determined to be about 25 percent.

In addition to the good yields and physical properties of munitions of the invention, a major unexpected advantage exists in that, after "tamping" into the casing, the density of the compositions closely approaches the theoretical density for the compositions. This increase in density is advantageous in that greater loadings of the psychotomimetic agent can be achieved than would otherwise be possible.

What is claimed is:

1. A composition comprising by weight:

(a) from about 40 to about 60% of a psychotomimetic agent, (b) from about 15 to about 40% of a nitrate, chlorate or perchlorate oxidizer, and (c) from about 15 to about 40% of a cross-linked organic polymeric binder comprising an aliphatic sulfur-containing organic compound having a plurality of mercapto groups (—SH) in the molecule, and a curing agent selected from the group of trifunctional tris[2(1-aziridinyl)ethyl]benzene tricarboxylates or an aliphatic sulfur-containing epoxy resin having a functionality of at least about 1.5, said binder comprising sufficient quantities of the components thereof so that the ratio of mercapto group equivalents to reactive group equivalents of the curing agent is from about 0.6 to about 1.4.

2. A composition as in claim 1 wherein the ratio of mercapto group equivalents to reactive group equivalents in the binder is from about 0.9 to about 1.1.

3. A composition as in claim 1 where, in the binder, the aliphatic sulfur-containing compound is a trifunctional thiol and the curing agent is an aliphatic sulfur-containing epoxy resin.

4. A composition as in claim 3 and including from 1 to about 8 weight percent based on the total weight of the disseminating composition, of a polymeric sulfide resin having a mercapto group equivalent weight of from about 100 to about 1300, and said polymeric sulfide resin having from about 30 to about 70 percent by weight of sulfur.

5. A composition as in claim 1 wherein the binder comprises a liquid aliphatic polymeric sulfide resin having a mercapto group equivalent weight of from about 100 to about 1300, and said polymeric sulfide resin having from about 25 to about 50 weight percent of sulfur, and wherein the curing agent is a tris [2(1-aziridinyl-)ethyl] benzene tricarboxylate.

6. A composition as in claim 1 wherein the oxidizer is potassium chlorate.

* * * * *